US008012109B1

(12) United States Patent
Lather, Sr.

(10) Patent No.: US 8,012,109 B1
(45) Date of Patent: Sep. 6, 2011

(54) SHOULDER MASSAGE APPARATUS

(76) Inventor: Michael A. Lather, Sr., Fremont, OH (US)

( * ) Notice: Subject to any disclaimer, the term of this patent is extended or adjusted under 35 U.S.C. 154(b) by 1194 days.

(21) Appl. No.: 11/694,197

(22) Filed: Mar. 30, 2007

(51) Int. Cl.
*A61H 1/00* (2006.01)

(52) U.S. Cl. ..... 601/15; 601/49; 601/79

(58) Field of Classification Search ..... 601/15, 601/46, 49, 56, 57, 69, 70, 71, 78, 79, 86, 601/87, 90, 93
See application file for complete search history.

(56) References Cited

U.S. PATENT DOCUMENTS

| | | | | |
|---|---|---|---|---|
| 4,732,140 | A | 3/1988 | Stoffregen | |
| 5,334,131 | A | 8/1994 | Omandam et al. | |
| 5,545,125 | A | 8/1996 | Tseng | |
| 6,007,501 | A | 12/1999 | Cabados et al. | |
| D444,240 | S | 6/2001 | Bautista, Jr. | |
| 2004/0133133 | A1 * | 7/2004 | Dreimann et al. | 601/15 |
| 2005/0059909 | A1 | 3/2005 | Burgess | |
| 2005/0256433 | A1 | 11/2005 | Lin | |

* cited by examiner

*Primary Examiner* — Quang D Thanh

(57) ABSTRACT

A shoulder massage apparatus includes a shoulder covering with an outer wall and an inner wall. An interior space is defined between the outer and inner walls. The covering includes a back wall, a front wall, a pair of side walls and a top wall that are integrally attached together. The top wall has a neck opening therein for receiving a neck of a person. The front wall has a front break therein. A plurality of massaging assemblies is provided. Each of the massaging assemblies is configured to oscillate and massage a portion of the person when the massage assemblies are turned on. Each of the massage assemblies is positioned within the interior space. An actuator is electrically coupled to the massaging assemblies to selectively allow the massaging assemblies to be turned on or off. A power source is electrically coupled to the plurality of massaging assemblies.

13 Claims, 5 Drawing Sheets

SHOULDER MASSAGE APPARATUS

BACKGROUND OF THE INVENTION

1. Field of the Invention

The present invention relates to shoulder massaging devices and more particularly pertains to a new shoulder massaging device for positioning on and massaging the shoulders, back and chest of a person.

2. Description of the Prior Art

The use of shoulder massaging devices is known in the prior art. While these devices fulfill their respective, particular objectives and requirements, the need remains for a device that can be positioned on a person and secured to the person and which includes means for massaging the person. By attaching the device to the person, the person will be assured that they will receive an adequate massage and that the massaging means will be retained in one spot on the body.

SUMMARY OF THE INVENTION

The present invention meets the needs presented above by generally comprising a shoulder covering comprised of a flexible material and including an outer wall and an inner wall. An interior space is defined between the outer and inner walls. The covering includes a back wall, a front wall, a pair of side walls and a top wall that are integrally attached together. The top wall has a neck opening therein for receiving a neck of a person. The front wall has a front break therein extending from a bottom edge of the front wall to a top edge of the front wall. The front wall includes a first front section and a second front section positioned on either side of the front break. A plurality of massaging assemblies is provided. Each of the massaging assemblies is configured to oscillate and massage a portion of the person when the massage assemblies are turned on. Each of the massage assemblies is positioned within the interior space. An actuator is electrically coupled to the massaging assemblies to selectively allow the massaging assemblies to be turned on or off. A power source is electrically coupled to the plurality of massaging assemblies.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
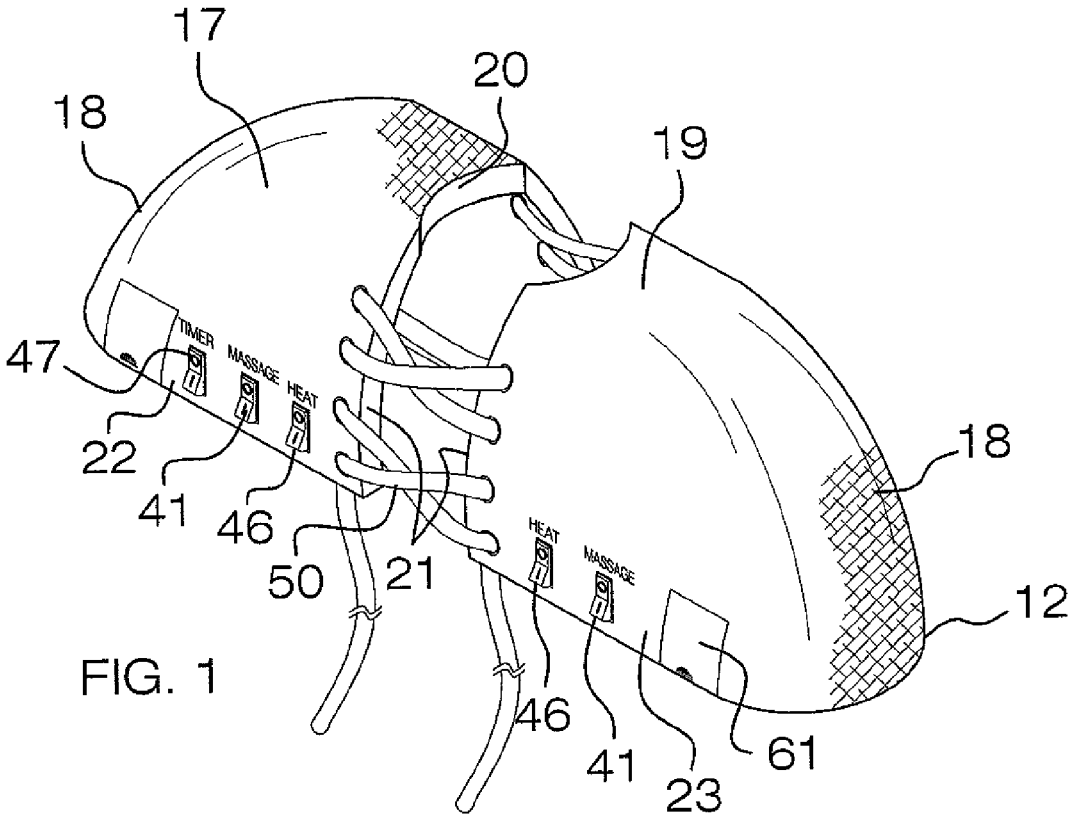
FIG. 1 is a perspective view of a shoulder massage apparatus according to the present invention.

With reference now to the drawings, and in particular to FIGS. 1 through 7 thereof, a new shoulder massaging device embodying the principles and concepts of the present invention and generally designated by the reference numeral 10 will be described.

As best illustrated in FIGS. 1 through 7, the shoulder massage apparatus 10 generally comprises a shoulder covering 12 comprised of a flexible material including an outer wall 13 and an inner wall 14. An interior space 15 is defined between the outer 13 and inner 14 walls. The covering 13 includes a back wall 16, a front wall 17, a pair of side walls 18 and a top wall 19 integrally attached together. The top wall 19 has a neck opening 20 therein for receiving a neck of a person 8. The front wall 17 has a front break 21 therein extending from a bottom edge of the front wall 17 to a top edge, or the neck opening 20, of the front wall 17. The front wall 17 includes a first front section 22 and a second front section 23 positioned on either side of the front break 21.

A plurality of massaging assemblies 30 is provided. Each of the massaging assemblies 30 is configured to oscillate and massage a portion of the person 8 wearing the covering 12 when the massage assemblies 30 are turned on. Each of the massage assemblies 30 is positioned within the interior space 15. The plurality of massage assemblies 30 includes at least one rear massager 31 positioned in the interior space 15 of the back wall 16, at least two front massagers 32 positioned in the interior space 15 of the front wall 17, and a pair of side massagers 33. Each of the first 22 and second 23 front sections has one of the front massagers 32 positioned therein. The interior space 15 of each of the side walls 18 has one of the side massagers 33 positioned therein. Each of the front 32 and rear 31 massagers are configured to move laterally back and forth when turned on and each of the side massagers 33 are configured to move vertically up and down when turned on. The massage assemblies 30 each include a vibrating motor 34 to oscillate massaging balls 35 and a movement motor 36 to drive wheels 37 along tracks 38 to move the massaging balls 35 either laterally or vertically.

Figure 2:
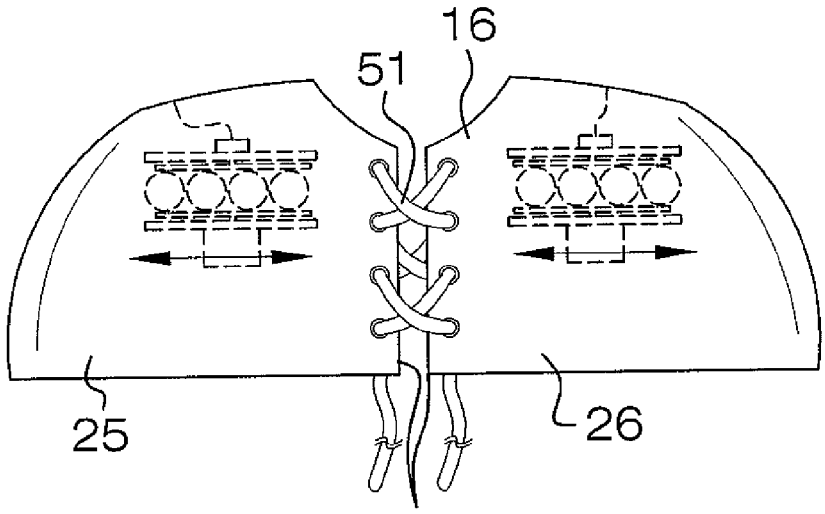
FIG. 2 is a back view of the present invention.
Figure 3:
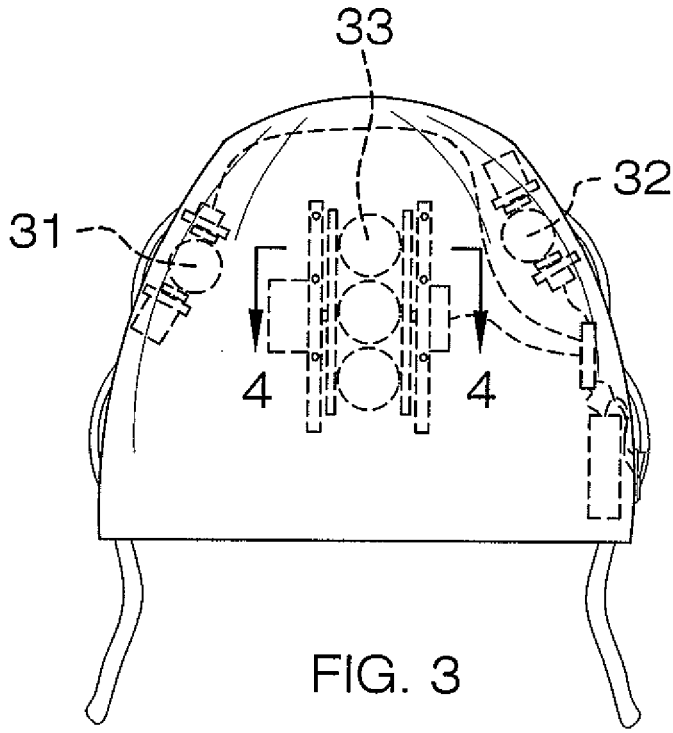
FIG. 3 is a side view of the present invention.
Figure 4:
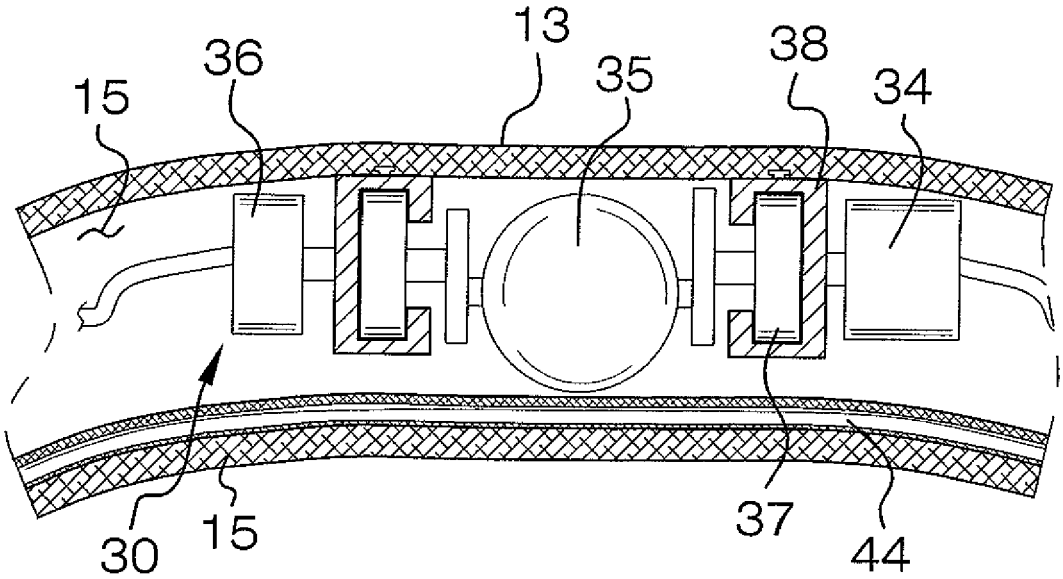
FIG. 4 is a cross-sectional view taken along line 4-4 of FIG. 3 of the present invention.
Figure 5:
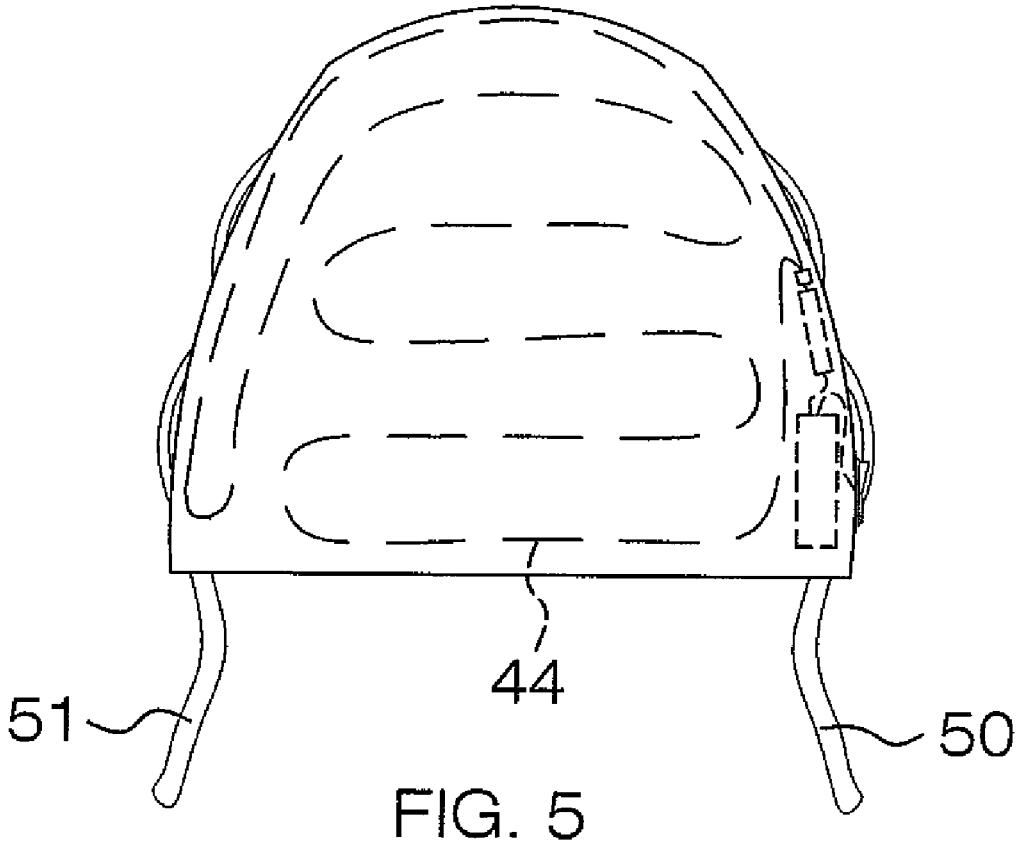
FIG. 5 is a side view of the present invention.
Figure 6:
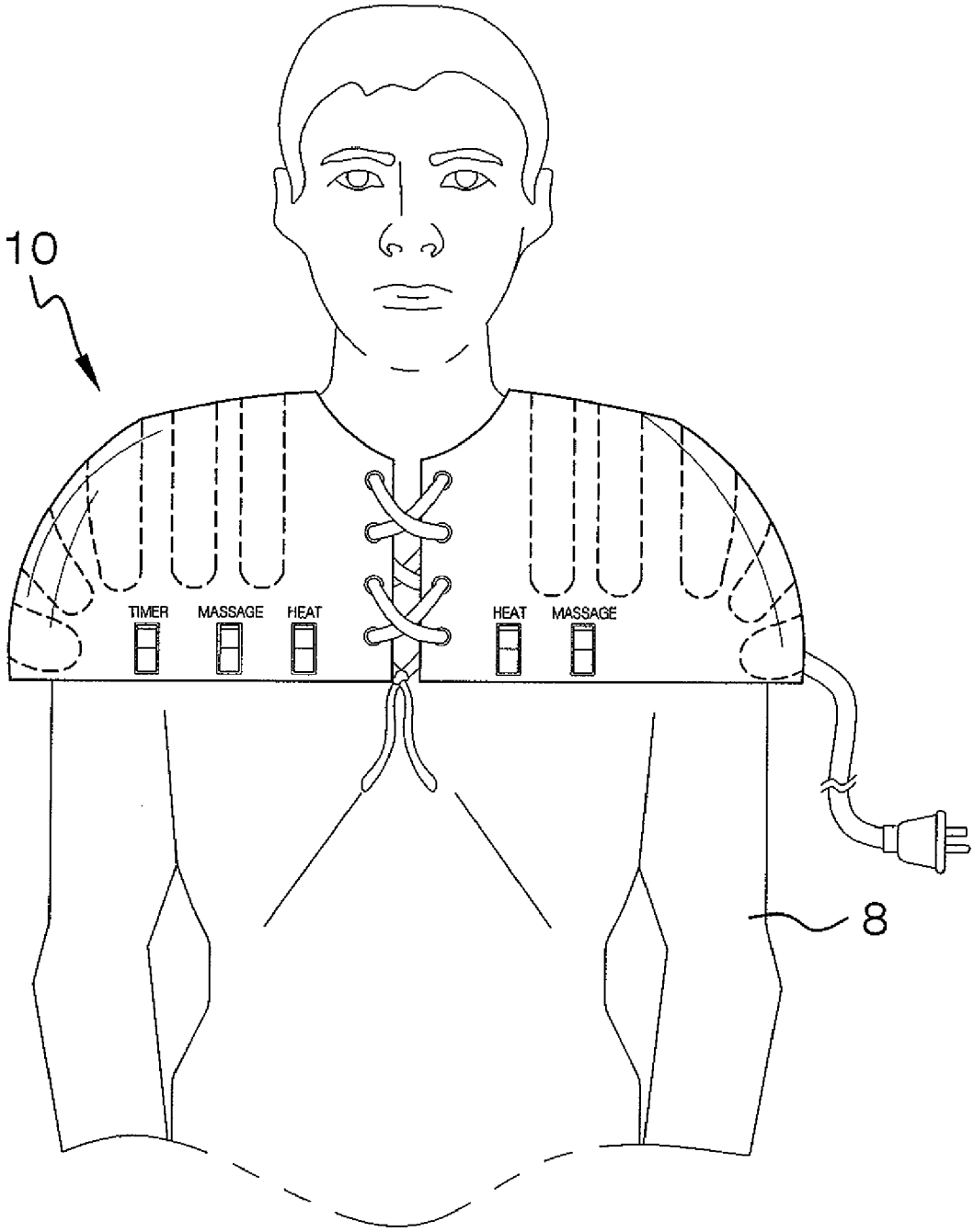
FIG. 6 is a front view of a second embodiment of the present invention.
Figure 7:
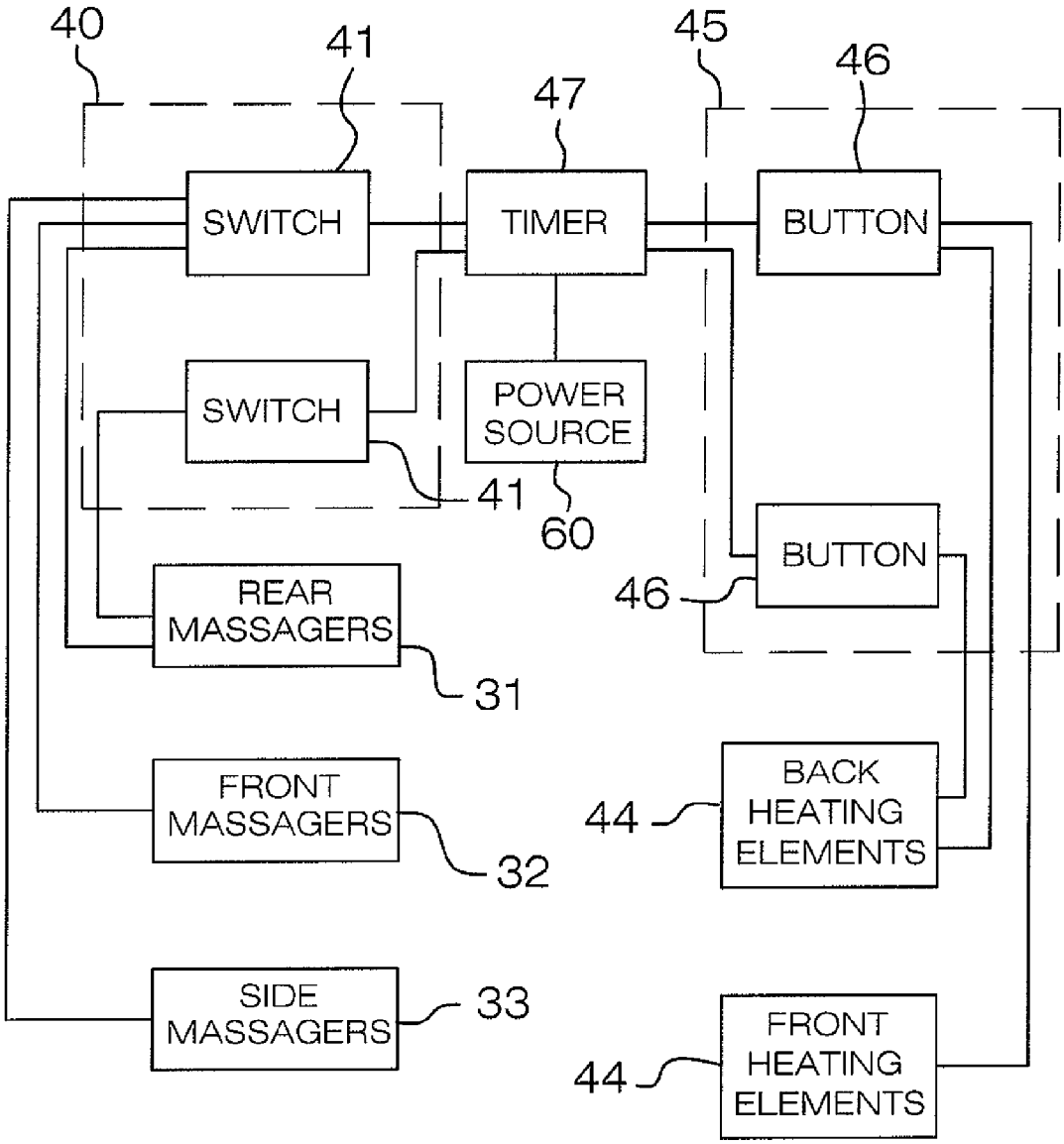
FIG. 7 is a schematic view of the present invention.

As shown in FIG. 2, the back wall 16 may have a back break 24 therein extending from a bottom edge of the back wall to a top edge, or neck opening 20, of the back wall 16. The back wall 16 includes a first back section 25 and a second back section 26 positioned on either side of the back break 24. In this configuration, the apparatus 10 includes at least two rear massagers 31 are positioned in the interior space 15 of the back wall 16. Each of the first 25 and second 25 back sections has one of the rear massagers 31 positioned therein.

An actuator 40 is electrically coupled to the massaging assemblies 30 to selectively allow the massaging assemblies 40 to be turned on or off. The actuator 40 includes multiple switches 41 to allow the selective turning on or off of all or some of the massaging assemblies 30.

A tie assembly 50 is attached to the front wall 17 to selectively secure the first 22 and second 23 front sections together along the front break 21. The tie assembly 50 includes an elongated tether laced through a plurality of holes extending through the front wall 17 and positioned on either side of the front break 21. The tie assembly 50 allows a person 8 to secure the covering tightly around their shoulders and back. A second tie assembly 51 is attached to the back wall 24 to selectively secure the first 25 and second 26 back sections together along the back break.

A plurality of heating elements 44 is positioned in the interior space 15. The heating elements 44 are configured to heat the covering 12 when the heating elements 44 are turned on. The heating elements 44 are positioned in each of the front 17, side 18, back 16, and top 19 walls. A control 45 is electrically coupled to the heating elements 44 to selectively allow the heating elements to be turned on or off. The control 45 includes a plurality of buttons 46 to allow the selective turning on or off of all or some of the heating elements 44. A timer 47 may be included to selectively control a length of time that the massage assemblies 30 and the heating elements 44 are turned on.

A power source 60 is electrically coupled to the plurality of massaging assemblies 30. The power source 60 is electrically coupled to the plurality of heating elements 44. The power source 60 may comprise an electrical cord plugged into a conventional outlet or one or more batteries mounted in compartments placed in the covering 12 and covered with one or more doors 61.

In use, the covering 12 is positioned on the shoulders of a person 8 and the tie assemblies 50 and 51 secured to retain the covering 12 on the person 8. The massage assemblies 30 are turned on to massage the shoulders, back and chest of the person. If needed or desired, the heating elements 44 may be turned on to heat the shoulders, back and chest of the person 8.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A shoulder massage system configured for being worn on the shoulders of a person, said system comprising:

a shoulder covering comprised of a flexible material including an outer wall and an inner wall, an interior space being defined between said outer and inner walls, said covering including a back wall, a front wall, a pair of side walls and a top wall being integrally attached together, said top wall having a neck opening therein for receiving a neck of the person, said front wall having a front break therein extending from a bottom edge of said front wall to a top edge of said front wall, said front wall including a first front section and a second front section positioned on either side of said front break;

a plurality of massaging assemblies, each of said massaging assemblies being configured to oscillate and massage a portion of the person when said massage assemblies are turned on, each of said massage assemblies being positioned within said interior space, said plurality of massage assemblies including at least one rear massager positioned in said interior space of said back wall and at least two front massagers positioned in said interior space of said front wall, each of said first and second front sections having one of said front massagers positioned therein, said plurality of massage assemblies including a pair of side massagers, said interior space of each of said side walls having one of said side massagers positioned therein;

an actuator being electrically coupled to said massaging assemblies to selectively allow said massaging assemblies to be turned on or off; and a power source being electrically coupled to said plurality of massaging assemblies;

a tie assembly being attached to said front wall to selectively secure said first and second front sections together along said front break; and said back wall having a back break therein extending from a bottom edge of said back wall to a top edge of said back wall, said back wall including a first back section and a second back section positioned on either side of said back break, said at least one rear massager including at least two rear massagers positioned in said interior space of said back wall, each of said first and second back sections having one of said rear massagers positioned therein.

2. The system according to claim 1, wherein each of said front and rear massagers is configured to move laterally back and forth when turned on.

3. The system according to claim 1, wherein each of said side massagers is configured to move vertically up and down when turned on.

4. The system according to claim 3, wherein each of said front and rear massagers is configured to move laterally back and forth when turned on.

5. The system according to claim 1, wherein said actuator includes multiple switches to allow the selective turning on or off of all or some of said massaging assemblies.

6. The system according to claim 1, said tie assembly including an elongated tether laced through a plurality of holes extending through said front wall and positioned on either side of said front break.

7. The system according to claim 1, further including a plurality of heating elements being positioned in said interior space, said heating elements being configured to heat said covering when said heating elements are turned on, a control being electrically coupled to said heating elements to selectively allow said heating elements to be turned on or off, said power source being electrically coupled to said plurality of heating elements.

8. The system according to claim 7, wherein said heating elements are positioned in each of said front, side, back, and top walls.

9. The system according to claim 8, wherein said control includes a plurality of buttons to allow the selective turning on or off of all or some of said heating elements.

10. The system according to claim 1, further including a second tie assembly being attached to said back wall to selectively secure said first and second back sections together along said back break.

11. A shoulder massage system configured for being worn on the shoulders of a person, said system comprising:

a shoulder covering comprised of a flexible material including an outer wall and an inner wall, an interior space being defined between said outer and inner walls, said covering including a back wall, a front wall, a pair of side walls and a top wall being integrally attached together, said top wall having a neck opening therein for receiving a neck of the person, said front wall having a front break therein extending from a bottom edge of said front wall to a top edge of said front wall, said front wall including a first front section and a second front section positioned on either side of said front break;

a plurality of massaging assemblies, each of said massaging assemblies being configured to oscillate and massage a portion of the person when said massage assemblies are turned on, each of said massage assemblies being positioned within said interior space, said plurality of massage assemblies including at least one rear massager positioned in said interior space of said back wall, at least two front massagers positioned in said interior space of said front wall, and a pair of side massagers, each of said first and second front sections having one of said front massagers positioned therein, said interior space of each of said side walls having one of said side massagers positioned therein, each of said front and rear massagers being configured to move laterally back and forth when turned on, each of said side massagers being configured to move vertically up and down when turned on;

an actuator being electrically coupled to said massaging assemblies to selectively allow said massaging assemblies to be turned on or off, said actuator including multiple switches to allow the selective turning on or off of all or some of said massaging assemblies;

a tie assembly being attached to said front wall to selectively secure said first and second front sections together along said front break, said tie assembly including an elongated tether laced through a plurality of holes extending through said front wall and positioned on either side of said front break;

a plurality of heating elements being positioned in said interior space, said heating elements being configured to heat said covering when said heating elements are turned on, said heating elements being positioned in each of said front, side, back, and top walls;

a control being electrically coupled to said heating elements to selectively allow said heating elements to be turned on or off, said control including a plurality of buttons to allow the selective turning on or off of all or some of said heating elements; and a power source being electrically coupled to said plurality of massaging assemblies, said power source being electrically coupled to said plurality of heating elements.

12. The system according to claim 11, wherein said back wall has a back break therein extending from a bottom edge of said back wall to a top edge of said back wall, said back wall including a first back section and a second back section positioned on either side of said back break, said at least one rear massager including at least two rear massagers positioned in said interior space of said back wall, each of said first and second back sections having one of said rear massagers positioned therein.

13. The system according to claim 12, further including a second tie assembly being attached to said back wall to selectively secure said first and second back sections together along said back break.

* * * * *